US011338173B2

(12) United States Patent
Mattson

(10) Patent No.: US 11,338,173 B2
(45) Date of Patent: May 24, 2022

(54) APPARATUS AND METHOD FOR STRENGTHENING THE FOOT, ANKLE, AND/OR LOWER LEG

(71) Applicant: Andre Mattson, Turlock, CA (US)

(72) Inventor: Andre Mattson, Turlock, CA (US)

( * ) Notice: Subject to any disclaimer, the term of this patent is extended or adjusted under 35 U.S.C. 154(b) by 0 days.

(21) Appl. No.: 16/894,252

(22) Filed: Jun. 5, 2020

(65) Prior Publication Data

US 2020/0391075 A1 Dec. 17, 2020

Related U.S. Application Data

(60) Provisional application No. 62/861,087, filed on Jun. 13, 2019.

(51) Int. Cl.

| | |
|---|---|
| ***A63B 23/08*** | (2006.01) |
| ***A63B 21/055*** | (2006.01) |
| ***A63B 21/00*** | (2006.01) |
| ***A63B 21/04*** | (2006.01) |
| ***A63B 23/10*** | (2006.01) |

(52) U.S. Cl.

CPC ..... *A63B 23/08* (2013.01); *A63B 21/0428* (2013.01); *A63B 21/0555* (2013.01); *A63B 21/0557* (2013.01); *A63B 21/4013* (2015.10); *A63B 21/4015* (2015.10); *A63B 23/10* (2013.01); *A63B 21/00058* (2013.01); *A63B 21/4025* (2015.10)

(58) Field of Classification Search

CPC ..... A63B 21/0428; A63B 21/0557; A63B 21/0555; A63B 21/4013; A63B 21/4015; A63B 21/00058; A63B 21/4025; A63B 23/08; A63B 23/10; A63B 2071/0694; A63B 2225/09; A63B 2209/10

See application file for complete search history.

(56) References Cited

U.S. PATENT DOCUMENTS

| | | | | |
|---|---|---|---|---|
| 1,373,211 | A * | 3/1921 | Tanner | A61F 5/019 602/30 |
| 4,869,499 | A * | 9/1989 | Schiraldo | A61H 1/0266 482/79 |
| 5,039,093 | A * | 8/1991 | Collier | A61H 1/0266 482/124 |
| 7,354,413 | B2 * | 4/2008 | Fisher | A61F 5/0113 602/23 |
| 9,387,108 | B2 * | 7/2016 | Darby, II | A61F 5/0111 |
| 2007/0130796 | A1 * | 6/2007 | Iwata | A63B 21/4025 36/11.5 |
| 2019/0201731 | A1 * | 7/2019 | Nguyen | A63B 21/00065 |

* cited by examiner

*Primary Examiner* — Megan Anderson

(74) *Attorney, Agent, or Firm* — Lee & Hayes, P.C.

(57) ABSTRACT

An ankle-strengthening device includes a stretchable band including a first portion and a second portion. A tubular portion has a proximal end and distal end. The tubular portion is fixed between the first portion of the stretchable band and the second portion of the stretchable band. The proximal end of the tubular portion has at an opening configured to receive a toe of a user. A fastener portion has a first attachment point and a second attachment point, such that, when fixed on the lower leg of the user, the first attachment point of the fastener is configured to connect with the first portion of the stretchable band, and the second attachment point of the fastener portion is configured to connect with the second portion of the stretchable band, thereby creating resistance to the user through dorsiflexion and/or pronation upon application of the device by the user.

20 Claims, 9 Drawing Sheets

APPARATUS AND METHOD FOR STRENGTHENING THE FOOT, ANKLE, AND/OR LOWER LEG

RELATED CASES

This application claims the benefit of priority to U.S. Application Ser. No. 62/861,087, filed Jun. 13, 2019, and entitled, "Apparatus and Method for Strengthening the Foot, Ankle, and Lower Leg," the entirety of which is incorporated by reference herein.

BACKGROUND

The human foot, ankle, and lower leg play an important role in physical activity. For example, when walking, the foot is the first point of contact with the ground and must both absorb the momentous forces upon the body and efficiently transfer those forces up the body's kinetic chain. Athletic trainers and other professionals, however, largely ignore the training needs that the foot, ankle, and lower leg require, and instead focus on treating symptoms. Current treatments include anti-inflammatory treatments, medication, and ultrasound therapies. Strengthening the foot, ankle, and lower leg may reduce the risk of injury. Common foot, lower leg, and ankle training exercises, however, provide little resistance and are not convenient for the user. A need exists for a convenient, resolution-based training approach which decreases incidence of injury while enhancing performance.

BRIEF DESCRIPTION OF THE DRAWINGS

The detailed description is described with reference to the accompanying figures. In the figures, the left-most digit(s) of a reference number identifies the figure in which the reference number first appears. The use of the same reference numbers in different figures indicates similar or identical components or features. Furthermore, the drawings may be considered as providing an approximate depiction of the relative sizes of the individual components within individual figures. However, the drawings are not to scale, and the relative sizes of the individual components, both within individual figures and between the different figures, may vary from what is depicted. In particular, some of the figures may depict components as a certain size or shape, while other figures may depict the same components on a larger scale or differently shaped for the sake of clarity.

DETAILED DESCRIPTION

Figure 1:
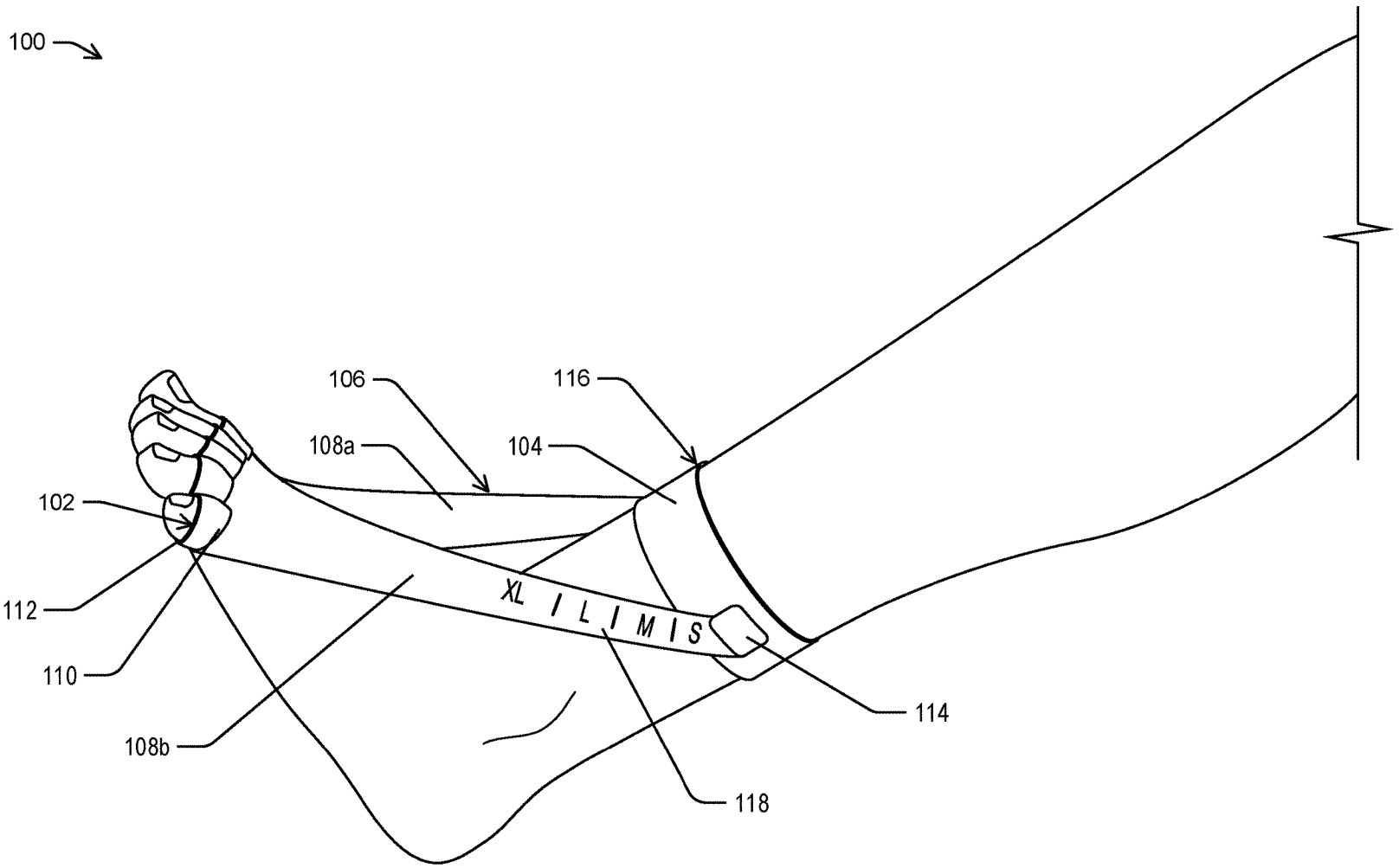
FIG. 1 illustrates a schematic view of an ankle strengthening device worn by a user in accordance with one or more embodiments.

The human foot and lower leg play a vital role in many physical activities. Each human foot contains a complex web of joints, ligaments, and muscles; both feet combined make up about 25% of the bones in the human body. The muscles of the lower leg are of great importance to the body—the feet are the first point of contact when walking, and therefore must deal with the most momentous forces. Further, when performing propulsive movements or accommodating high-force absorption, the foot needs to be strong enough not only to withstand the imposed forces, but to efficiently transfer those forces up the body's kinetic chain.

Despite their complex nature, the human foot and lower leg, as discussed above, are frequently disregarded in exercise. Rather, physical therapists and other trainers tend to focus on providing treatments of symptoms, such as anti-inflammatory treatments/medication, ultrasound or microcurrent modalities, compression, ice and heat, and/or support devices such as ankle braces or orthotic inserts, which force new movement patterns upon the user. Further, when physical therapists and other trainers address the strengthening of the foot and lower leg, they commonly prescribe exercises such as calf raises, picking up marbles, gripping towels, and using resistance bands to increase stability and range of motion. These exercises, however, provide little resistance, are not convenient, and are not effective. Resistance bands, for example, generally need to be attached to an external apparatus, such as a table.

Further, current methods of foot and lower leg strengthening largely disregard neural patterning. The muscles of the lower leg and foot work in conjunction to respond appropriately to their movement demands. As such, training in isolation can decrease the efficaciousness in neural recruitment and patterning. For example, it is not natural to dorsiflex the foot via lower leg firing without also activating the extensors of the foot as well. Similarly, for plantar flexion, when the flexors of the lower leg fire, the intrinsic muscles of the foot flex as well. Furthermore, humans are anatomically designed to allow more range of motion through inversion than eversion. Humans naturally invert the foot when flexing and pushing and evert the foot when dorsiflexing. When decelerating, humans naturally heel-strike, forcing the extenders of the lower leg and foot to work together. As such, there is a need for a portable, practical, and convenient way to strengthen the lower leg and foot, while protecting the ankle joint.

In light of the above deficiencies, this application relates to an ankle strengthening device and methods for resistance training which strengthen the musculature of the foot and lower leg. More specifically, the methods described with respect to the ankle strengthening device discussed hereinafter may provide flexion, extension, inversion, and eversion capabilities via stretchable bands. In an embodiment, the ankle strengthening device may implement stretchable bands to provide pronation and/or supination resistance as a resisted plantar flexor and/or a resisted dorsiflexor. Such resistance not only provides the user with a method of strengthening but may also enhance functional range of motion and flexibility via joint allowance.

The ankle strengthening device, in an embodiment, may include a stretchable band portion, a tubular portion, and a fastener portion. In an embodiment, the stretchable band may have a first portion and/or a second portion. The tubular portion, in an embodiment, may have a proximal end and/or distal end, and the tubular portion may be fixed between the first portion of the stretchable band and the second portion of the stretchable band. The proximal end of the tubular portion may, in an embodiment, have at least one opening configured to receive at least one phalange (toe) of a user in a tunnel-like fashion. Additionally, and/or alternatively, the ankle strengthening device may have a fastener portion, which may be configured to be fixed on the lower leg of a user, such as the mid-calf, for example. The fastener portion may have a first attachment point and/or second attachment point, which may include, but is not limited to, Velcro, snap buttons, and/or hooks. In an embodiment, the first attachment point may be configured to receive the first portion of the stretchable band. Additionally, and/or alternatively, the second attachment point may be configured to receive the second portion of the stretchable band. Thus, in an embodiment, resistance may be created by the user wearing the ankle strengthening device plantar flexing, dorsiflexing, inverting, or everting the foot.

In an embodiment, the fastener portion of the ankle strengthening device may be positioned such that the first attachment point is located on the lateral position of the user's leg, and/or the second attachment point is located on the medial position of the lower leg. In an embodiment, the first portion of the stretchable band may stretch across the top of the user's foot along the fibula to the first attachment point. In this position, the first portion of the stretchable band may be used to pull the user's phalanges upwards and inverted into extension (dorsiflexion) and/or pull the ankle joint into pronation, strengthening the plantar flexors of the lower leg and foot. Additionally, and/or alternatively, the ankle strengthening device may be used to strength the dorsiflexors of the lower leg and foot. For example, the second portion of the stretchable band may wrap under the foot along the distal surface of the tibia to the second attachment point. In this position, the second portion of the stretchable band may pull the lower leg and phalanges into flexion, lengthening the dorsiflexors of the foot and pulling the ankle joint into supination. The fastener portion of the ankle strengthening device may be positioned such that the first attachment point is located on the lateral position of the user's leg, and/or the second attachment point is located on the medial position of the lower leg. This may allow the ankle joint to be strengthened though anatomically designed ranges of motion during kinetic sequences of movement.

In an embodiment, the fastener portion of the ankle strengthening device may be positioned such that the first attachment point is located on the medial position of the user's leg, and/or the second attachment point is located on the lateral position of the lower leg. In an embodiment, the first portion of the stretchable band may stretch across the top of the user's foot along the tibia to first attachment point. In this position, the first portion of the stretchable band may be used to pull the user's phalanges upwards and everted into extension (dorsiflexion) and/or pull the ankle joint into pronation, strengthening the plantar flexors of the lower leg and foot. Additionally, and/or alternatively, the ankle strengthening device may be used to strength the dorsiflexors of the lower leg and foot. For example, the second portion of the stretchable band may wrap under the foot along the distal surface of the tibia to the second attachment point. In this position, the second portion of the stretchable band may pull the lower leg and phalanges into flexion, lengthening the dorsiflexors of the foot and pulling the ankle joint into supination. The fastener portion of the ankle strengthening device may be positioned such that the first attachment point is located on the medial position of the user's leg, and/or the second attachment point is located on the lateral position of the lower leg.

Resistance levels may, in an embodiment, be adjusted. For example, the first portion and/or the second portion of the stretchable band may have varying levels of resistance. In an embodiment, the first portion of the stretchable band and/or second portion of the stretchable band may have small, medium, large, and extra-large resistance levels, where small indicates the least amount of resistance and extra-large indicates the most. Extra-large resistance may, in an embodiment, be located on the stretchable band closest to the tubular portion, whereas small resistance may be located farthest away. Thus, the user may vary the amount of resistance used when wearing the ankle-strengthening device.

Further, the user may decide to omit the use of the tubular portion completely. For example, the use may hold the first portion and/or second portion of the stretchable band. This may allow the user complete control as to the level and direction of resistance by the ankle-strengthening device.

FIG. 1 illustrates a schematic view of an ankle strengthening device 100 worn by a user in accordance with one or more embodiments. In an embodiment, the ankle strengthening device 100 may include at least one tubular portion 102, and a fastener portion 104, and a stretchable band 106. In an embodiment, the stretchable band 106 may include a first portion 108*a* and a second portion 108*b*, one or both of which may include an elastic material. Though not expressly depicted, it is contemplated that the stretchable band 106 may be a solitary piece, either formed unitarily or otherwise constructed such that the first portion 108*a* and the second portion 108*b* are fixed together. In the instance that the first portion 108*a* and the second portion 108*b* are fixed together, the depiction in FIG. 2 allows for either interpretation of a fixed unit or a separable two component unit. In an embodiment, the first portion 108*a* of the stretchable band 106 and/or the second portion 108*b* of the stretchable band 106 may taper in shape, as depicted. However, other non-tapering shapes and designs are contemplated.

In an embodiment, the at least one tubular portion 102 has a proximal end 110 and a distal end 112 and the at least one tubular portion 102 may be fixed to the stretchable band 106. For example, the tubular portion 102 may be fixed between the first portion 108*a* of the stretchable band 106 and the second portion 108*b* of the stretchable band 106. The proximal end 110 of the tubular portion 102 an opening configured to receive at least one toe of a user's foot in a tunnel-like fashion. Additionally, though depicted with an opening at the distal end 112 of the at least one tubular portion 102, it is contemplated that the distal end 112 may be closed to surround an end of the user's toe therein.

Figure 2:
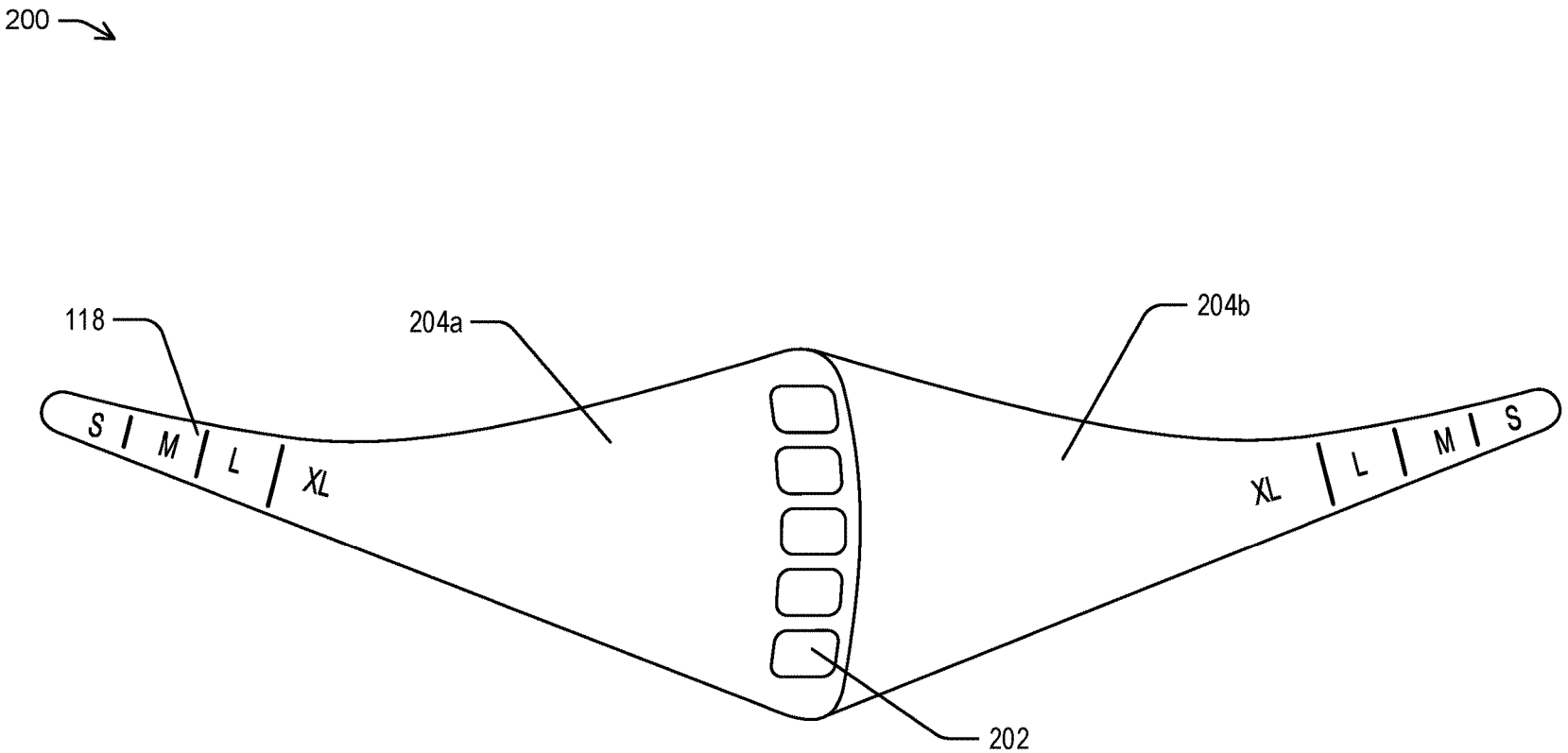
FIG. 2 illustrates a stretchable band and a tubular portion of an ankle strengthening device in accordance with one or more embodiments.

In an embodiment as depicted in FIGS. 1 and 2, the ankle strengthening device 100 includes five tubular portions 102, aligned to receive the five sequential toes of the user. However, as indicated above, fewer than five openings may be embodied. Moreover, in an embodiment having fewer than five tubular portions 102, a determination may be made regarding which toe(s) a particular user may select to insert into the tubular portions 102. That is, for example, a user may choose to have a tubular portion that receives the first large digit or any other one or more digits. As such, the tubular portions on a device having fewer than five tubular portions may be spaced apart to receive one or more predetermined toes, while not including a tubular portion to receive other one or more toe(s).

As stated above, the ankle strengthening device 100 may include a fastener portion 104, which may be configured to be fixed on the lower leg of a user, such as the mid-calf, for example. It is contemplated, however, that a user may choose to secure or simply hold the stretchable band manually. Nevertheless, in an embodiment including a fastener portion 104, the fastener portion 104 may be hollow and configured to circumscribe the lower leg of the user, and may include a material suitable to prevent the fastener portion 104 from changing positions on the user's leg. Moreover, the material selected may incorporate characteristics to provide a comfortable and simultaneously constricting quality to be secured to the leg. In an embodiment, the fastener portion 104 may be annular in shape (see FIG. 3) such that in order to place the fastener portion 104 on the leg, the user would slide the fastener 104 over the user's foot, as one would do to wear a sock. In an alternative embodiment, the fastener portion 104 may be secured around the user's leg as an elongated band that is wrapped around the leg, and then secured in place using one or more of the following fastening mechanisms, such as but not limited to: zippers, ties, Velcro, snap buttons, hooks, etc.

In an embodiment, the fastener portion 104 may be adjusted to tighten, loosen, and/or or remove the fastener portion 104. The fastener portion 104 may include a first attachment point 114 and/or a second attachment point 116 (not visible in FIG. 1, but see FIG. 3), which may include fastening mechanisms as described above, such as Velcro, snap buttons, hooks, etc. In an embodiment, the first attachment point 114 may be configured to connect with, receive, or otherwise attach to the first portion 108*a* of the stretchable band 106. Additionally, and/or alternatively, the second attachment point 116 may be configured to connect with, receive, or otherwise attach to the second portion 108*b* of the stretchable band 106. Thus, due to the elastic nature of the material used for the stretchable band 106, resistance may be created by the user wearing the ankle strengthening device upon dorsiflexing and/or pronating.

In an embodiment, the resistance levels occurring when using the device 100 may be adjusted. For example, the first portion 108*a* of the stretchable band 106 and/or the second portion 108*b* of the stretchable band 106 may have varying levels of resistance 118, which levels may be the same or different from each other. Moreover, the amount of resistance within the same stretchable band may vary without a change in material, for example, by merely adjusting the amount of stretch being applied to the first portion 108*a* of the stretchable band 106 and/or the second portion 108*b*. In an embodiment, the first portion 108*a* of the stretchable band 106 and/or second portion 108*b* of the stretchable band 106 may have small (S), medium (M), large (L), and extra-large (XL) levels of resistance, where small indicates a lesser amount of resistance and extra-large indicates a greater amount of resistance, as expected by the naming convention used. For example, a user wishing to implement an extra-large resistance may stretch the first portion 108*a* (and/or the second portion 108*b*) to such an extent that the area of the first portion 108*a* labeled "XL" is in contact with the first attachment point 114 of the fastener portion 104. That is, the "XL" is pulled farther away from the tubular portion 102 than when left at rest or when the area labeled "S" is in contact with the first attachment point 114 of the fastener portion 104. As such, a user desiring small resistance "S" may limit the amount of stretching done to the first portion 108*a* (and/or the second portion 108*b*) by merely attaching the area labeled "S" to the first attachment point 114. Similarly, the resistance may be varied for the second portion 108*b* with respect to attaching the second portion 108*b* to the second attachment point 116 (see FIG.3). Thus, the user may vary the amount of resistance used when wearing the ankle-strengthening device.

It is noted that although four levels of resistance 118 are depicted in embodiment of the device 100 in FIG. 1, more or less levels of resistance may be used. Further, while the levels of resistance 118 are herein defined as "sizes" (S, M, L, XL), other labels may be used.

Additionally, and/or alternatively, it is contemplated that each component of the ankle strengthening device 100 may be separable for cleaning, repair, replacement, exchange, etc., independent of each other. For example, in an embodiment, the ankle strengthening device 100 may allow for interchangeable stretchable bands, wherein the interchangeable bands may provide varying levels of resistance.

Further, the user may decide to omit the use of the tubular portion completely. For example, the user may hold the first portion and/or second portion of the stretchable bands. This may allow the user additional self-regulated control as to the level and direction of resistance by the ankle-strengthening device.

FIG. 2 illustrates an alternative embodiment of a stretchable band 200, which does not include an extended tubular portion, but rather, the stretchable band 200 instead includes one or more apertures 202, through or into which a user may insert one or more corresponding toes. As indicated above, in an embodiment where the stretchable band 200 includes two portions, a first portion 204*a* may connect either fixedly or separably to a second portion 204*b* of the stretchable band 200. Other aspects of the stretchable band 200 that are similar to the features described above with respect to the stretchable band 106, such as size, shape, material selection, structure, etc. may be similarly appreciated here, and for the sake of conciseness are not redescribed here.

Figure 3:
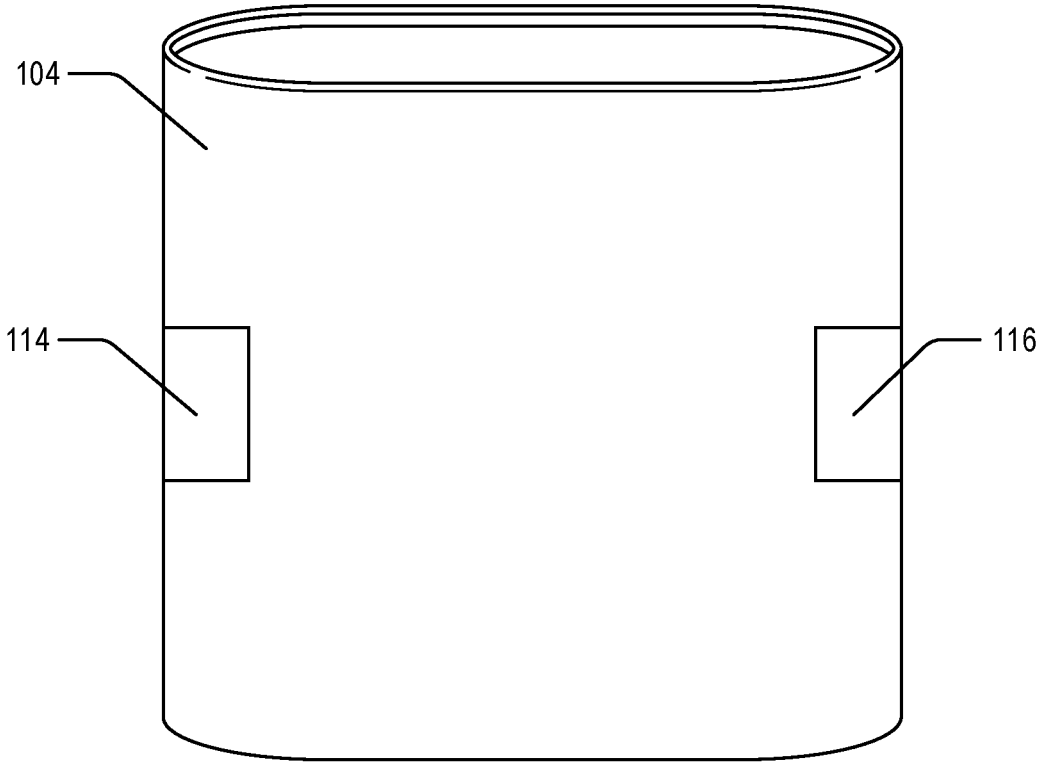
FIG. 3 illustrates a three-dimensional (3D) view of a fastener portion of an ankle strengthening device in accordance with one or more embodiments.

FIG. 3 illustrates a perspective view of the fastener portion 104 of the ankle strengthening device 100 in FIG. 1. As stated above, in an embodiment, the fastener portion 104 may have a first attachment point 114 and/or a second attachment point 116. Although depicted in the current embodiment as, respectively, on the left and right sides of the fastener portion 104, the first attachment point 114 and/or second attachment point 116 may be located at any position on the fastener portion 104. For example, the first attachment point 114 may be located on the medial position of the leg of the user, and the second attachment point 116 may be located on the lateral position of the leg of a user. Additionally, and/or alternatively, the first attachment point 114 may be located on the lateral position of the leg of the user, and the second attachment point 116 may be located on the medial position of the leg of a user.

Furthermore, the stretchable band 200 may be attached to a fastener portion 104, as described above with respect to the stretchable band 106.

Figure 4:
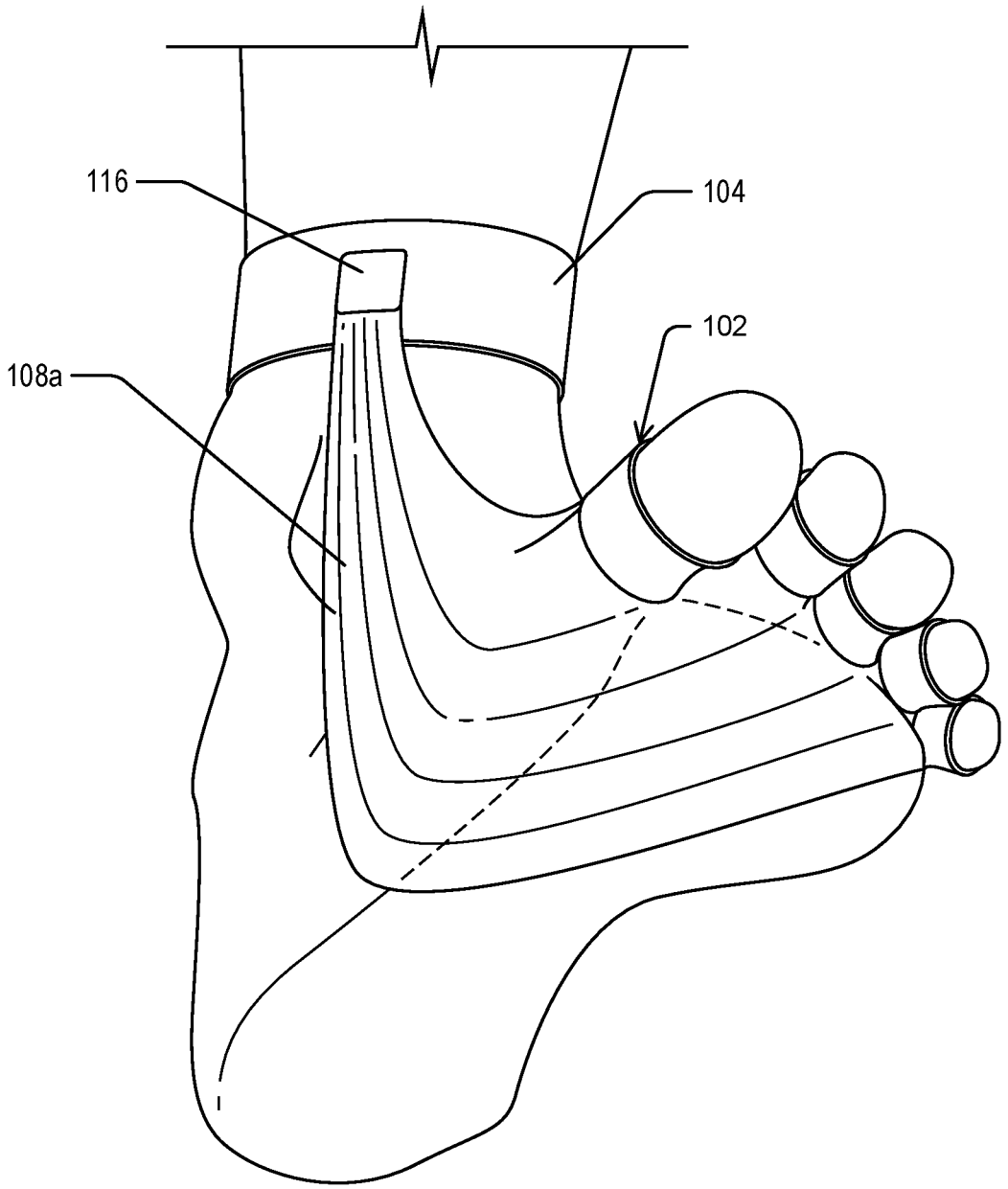
FIG. 4 illustrates an underside view of an example ankle strengthening device worn by a user in accordance with one or more embodiments.

FIG. 4 illustrates an underside view of an example ankle strengthening device 100 worn by a user in accordance with one or more embodiments. As shown, the second attachment point 118 of the fastener portion 104 may be located on the medial position of the leg. It is noted, in an embodiment, a user may elect to use only the second portion 108*b* (or only the first portion 108*a*, see FIG. 5) of the stretchable band 106. As such, in an embodiment, the second portion 108*b* of the stretchable band 106 may wrap under the foot along the distal surface of the tibia to the second attachment point 116. In this position, the second portion 108*b* of the stretchable band may pull the lower leg and phalanges, attached via the tubular portion 102, into flexion, lengthening the dorsiflexors of the foot and pulling the ankle joint into supination.

Figure 5:
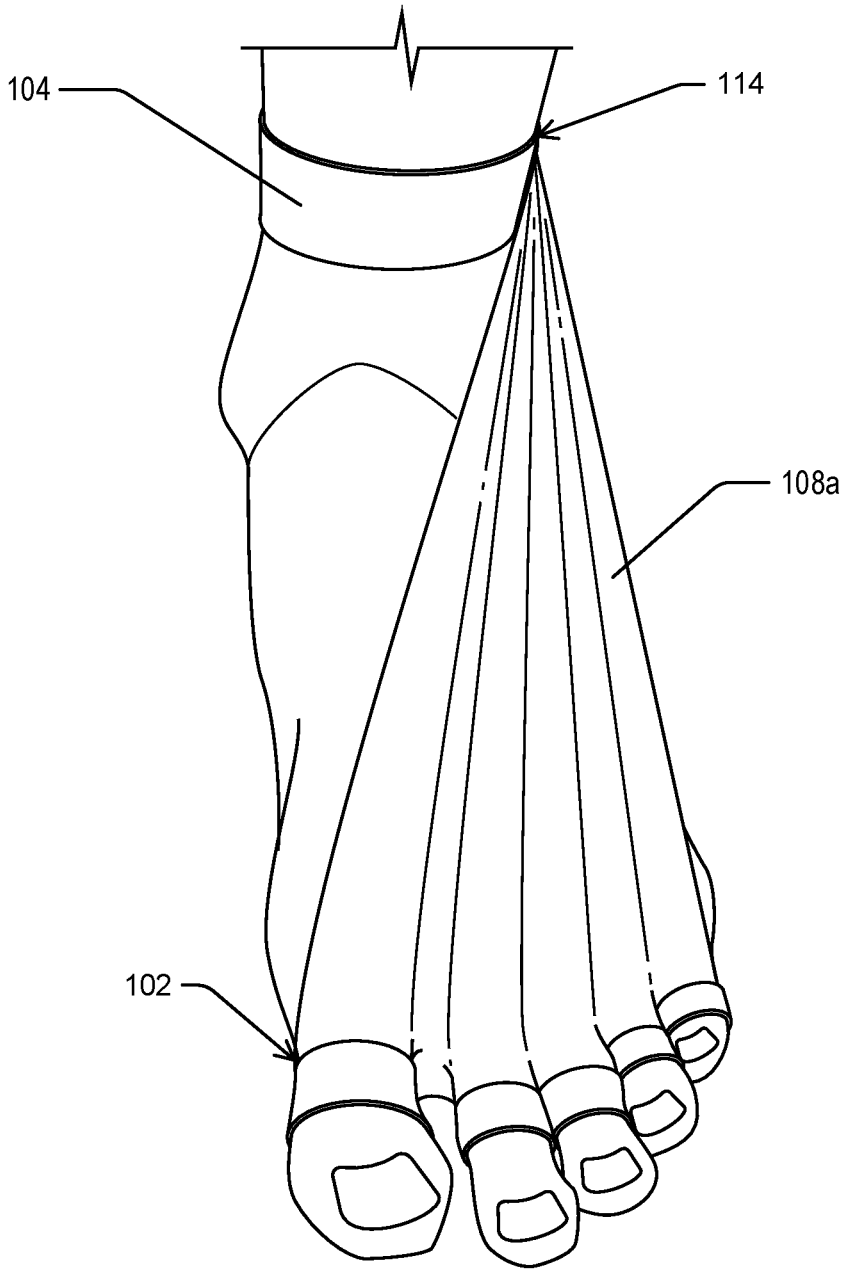
FIG. 5 illustrates an anterior view of an example ankle strengthening device worn by a user in accordance with one or more embodiments.

FIG. 5 illustrates an anterior view of an example ankle strengthening device 100 worn by a user in accordance with one or more embodiments. As shown, the first attachment point 114 of the fastener portion 104 may be located on the lateral position of the leg. It is noted that, in an embodiment, a user may elect to use only the first portion 108*a* of the stretchable band. As such, in an embodiment, the first portion 108*a* of the stretchable band 106 may stretch across the top of the user's foot along the fibula to first attachment point 114. In this position, the first portion 108*a* of the stretchable band may be used to pull the user's toes, via the tubular portion 102, upwards and inverted into extension (dorsiflexion) and/or pull the ankle joint into pronation, thereby strengthening the plantar flexors of the lower leg and foot.

Figure 6:
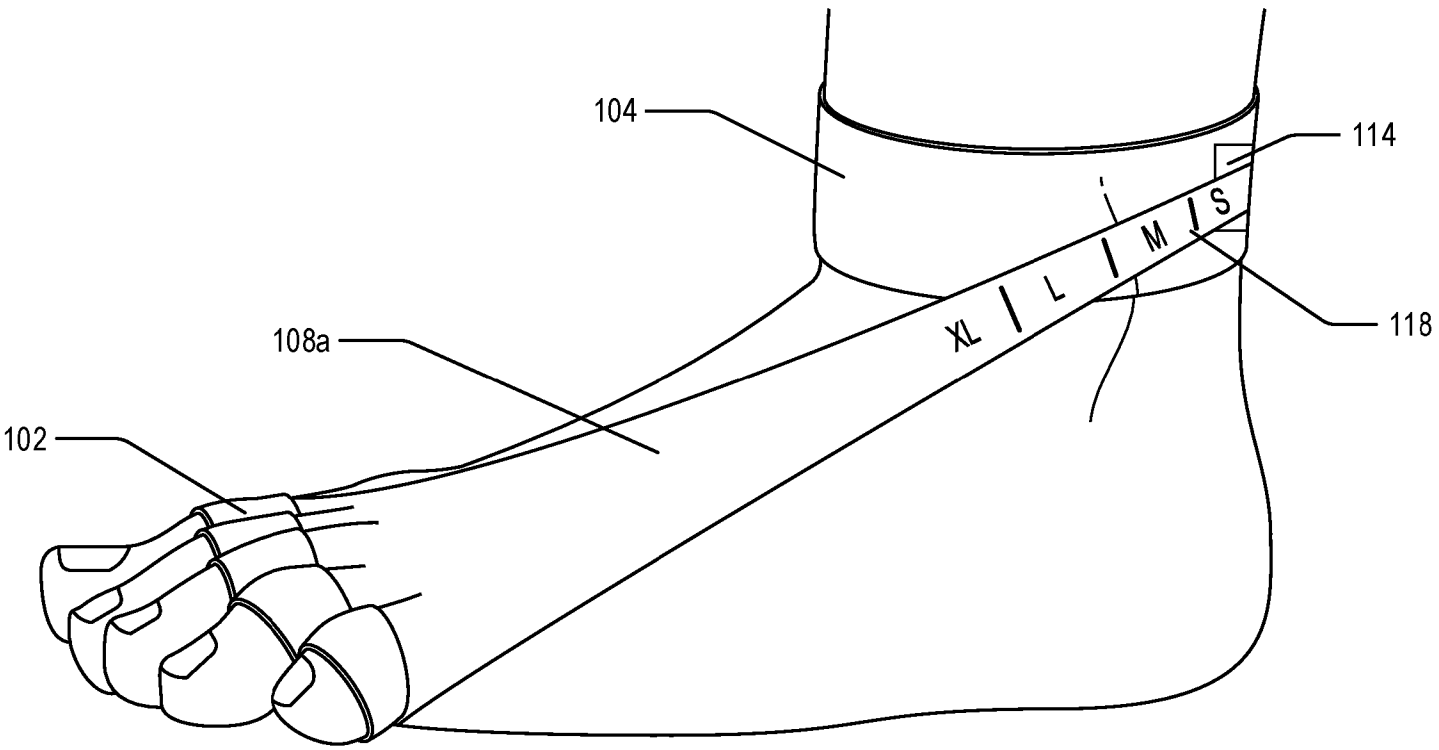
FIG. 6 illustrates a lateral view of an example ankle strengthening device worn by a user in accordance with one or more embodiments.

FIG. 6 illustrates a lateral view of an example ankle strengthening device 100 worn by a user in accordance with one or more embodiments. As shown, the first attachment point 114 of the fastener portion 104 may be located on the lateral position of the leg. Additionally, in this embodiment, only the first portion 108*a* of the stretchable band may be engaged. As such, in an embodiment, the first portion 108*a* of the stretchable band may stretch across the top of the user's foot to the first attachment point 114. In an embodiment, the user may adjust the position of the fastener portion 104 to increase and/or decrease the resistance applied, as described above. Further, in addition to the varying levels of resistance 118, positioning the fastener portion 104 closer to the ankle joint may result in less resistance, while positioning the fastener portion 104 higher up on the calf may result in greater resistance.

Figure 7:
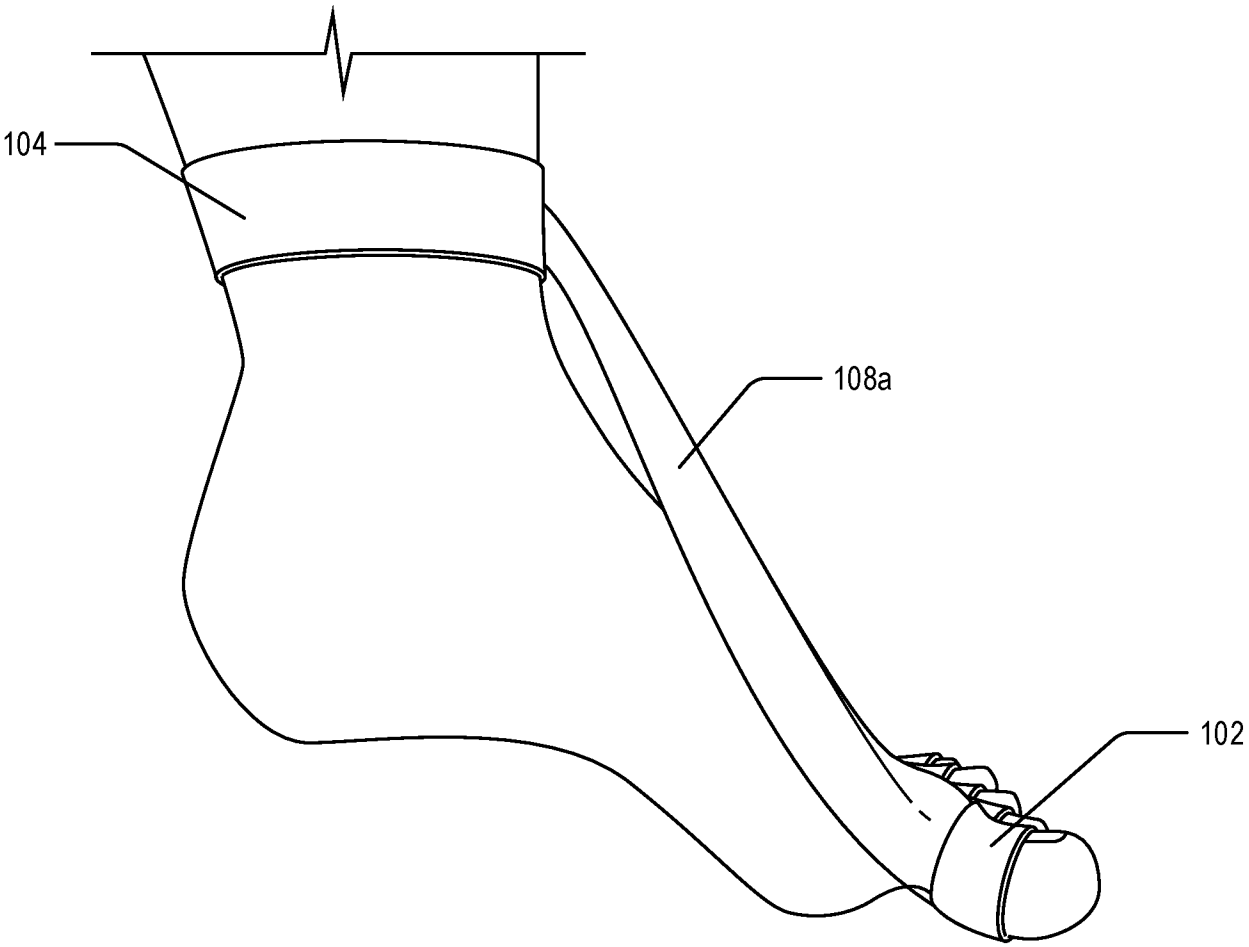
FIG. 7 illustrates a medial view of an example ankle strengthening device worn by a user in accordance with one or more embodiments.

FIG. 7 illustrates a medial view of an example ankle strengthening device worn by a user in accordance with one or more embodiments. In this position, the first portion 108*a* of the stretchable band 106 may be used to pull the user's toe(s) upwards and inverted into extension (dorsiflexion) and/or pull the ankle joint into pronation. As depicted, the user may push against the resistance into dorsiflexion, strengthening the plantar flexors of the lower leg and foot.

Figure 8B:
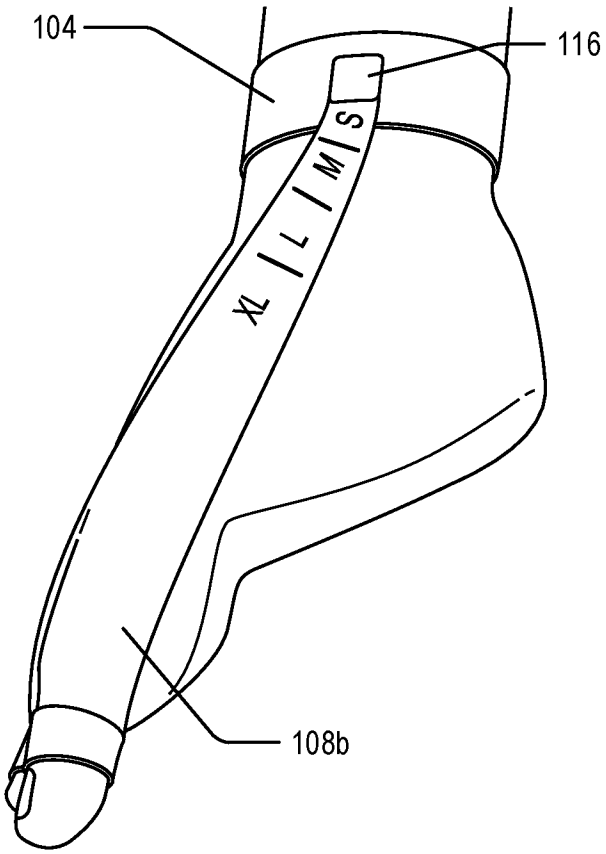
FIG. 8B illustrates a medial view of an example ankle strengthening device worn by a user while the user is in planter flexion.
Figure 8A:
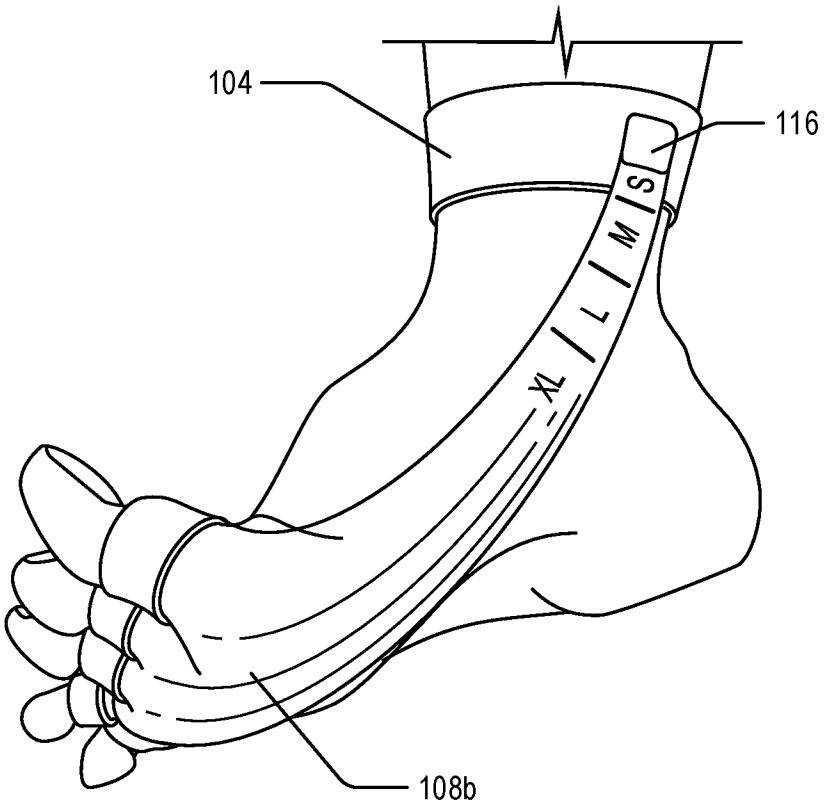
FIG. 8A illustrates a medial view of an example ankle strengthening device worn by a user while the user is in dorsiflexion and planter flexion.

FIGS. 8A and 8B illustrate a medial view of an example ankle strengthening device 100 worn by a user while the user is alternating between dorsiflexion (toes pointed upward) and planter flexion (toes pointed downward). In an embodiment, the second portion 108*b* of the stretchable band may wrap under the foot along the distal surface to the second attachment point 116 of the fastener portion 104. FIGS. 8A and 8B depict only the second portion 108*b* of the stretchable band engaged. However, the first portion 108*a* and/or the second portion 108*b* of the stretchable band may be used, in an embodiment. Further, FIGS. 8A and 8B depict the second attachment point 116 of the fastener portion 104 located on the medial position of the leg. However, as stated above, the first attachment point 114 and/or the second attachment point 116 may be adjusted and may be located at any point on the fastener portion 104.

FIG. 8A illustrates a medial view of an example ankle strengthening device 100 worn by a user while the user is in dorsiflexion. The resistance created by the second portion 108*b* of the stretchable band 106 may engage muscles, tendons, and/or ligaments in the front of the foot, for example. These may include, but are not limited to, the tibialis anterior, extensor hallucis longus, extensor digitorum longus, and/or the peroneus tertius. Conversely, FIG. 8B illustrates a medial view of the example ankle strengthening device 100 depicted in FIG. 8A worn while the user is in plantar flexion. The resistance created by the second portion 108*b* of the stretchable band may engage muscles, tendons, and/or ligaments on the posterior of the leg, foot, and ankle joint, for example. These may include, but are not limited to, the tibialis posterior, flexor digitorum longus, gastrocnemius, and/or soleus. By rotating the foot and lower leg between the positions depicted in FIG. 8A and FIG. 8B, the ankle strengthening device may engage the muscles, tendons, and/or ligaments, for example, in the foot and lower leg, increasing range of motion and strength. Additionally, it is noted that while the present embodiments depict the foot in dorsiflexion and plantar flexion, the user may rotate the foot in any angle or direction within the range of motion, encouraging engagement of all aspects of the foot and lower leg.

Figure 9B:
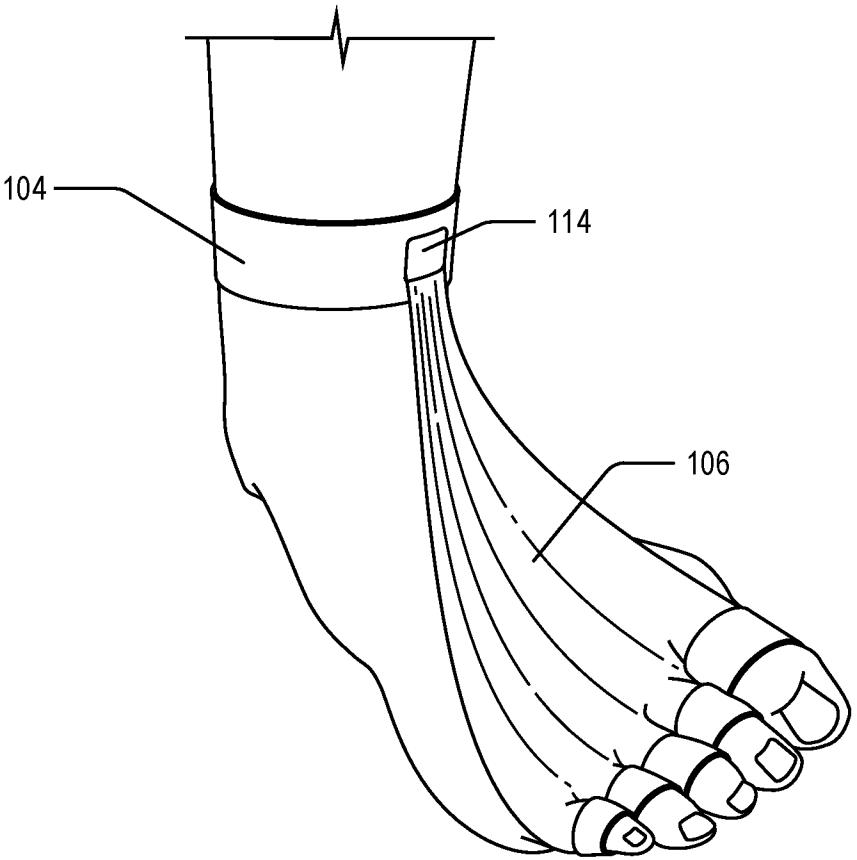
FIG. 9B illustrates a medial view of an example ankle strengthening device worn by a user while the user is in supination.
Figure 9A:
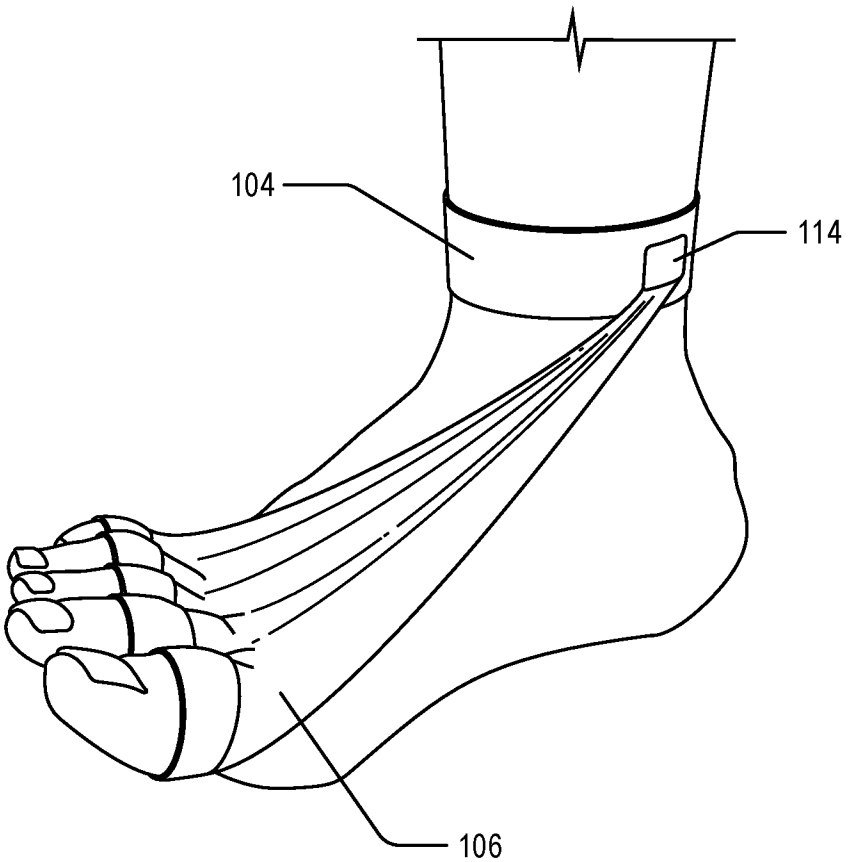
FIG. 9A illustrates a medial view of an example ankle strengthening device worn by a user while the user is in pronation.

FIGS. 9A and 9B illustrate a medial view of an example ankle strengthening device 100 worn by a user while the user is alternating between pronation (foot inward) and supination (foot outward). In an embodiment, the first portion 108*a* of the stretchable band 106 may stretch across the top of the user's foot to the first attachment point 114 of the fastener portion 104. FIGS. 9A and 9B depict only the first portion 108*a* of the stretchable band engaged. However, the first portion 108*a* and/or the second portion 108*b* of the stretchable band may be used, in an embodiment.

FIG. 9A illustrates a medial view of an example ankle strengthening device 100 worn by a user while the user is in pronation. In an embodiment, the resistance created by the first portion 108*a* of the stretchable band may engage muscles, ligaments, and/or tendons in the foot and lower leg, for example. These may include, but are not limited to, the tibialis anterior, tibialis posterior, flexor digitorum longus, and/or the flexor hallucis longus. Conversely, FIG. 9B illustrates a medial view of the example ankle strengthening device 100 depicted in FIG. 9A worn while the user is in plantar flexion. In an embodiment, the resistance created by the second portion 108*b* of the stretchable band may engage muscles, tendons, and/or ligaments of the foot and lower leg, for example. These may include, but are not limited to, fibularis longus, fibularis brevis, and/or the extensor digitorum longus. By rotating the foot and lower leg between the positions depicted in FIG. 9A and FIG. 9B, the ankle strengthening device may engage the muscles, tendons, and/or ligaments, for example, in the foot and lower leg, increasing range of motion and strength. Additionally, it is noted that while the present embodiments depict the foot in dorsiflexion and plantar flexion, the user may rotate the foot in any angle or direction within the range of motion, encouraging engagement of all aspects of the foot and lower leg.

It is noted that a method of strengthening a user's ankle and/or other leg or foot structures may include the use of the ankle strengthening device 100, as described above in each of structure, function, and biological application and movement of the body aspects.

The architectures, systems, and individual elements described herein may include many other logical and physical components, of which those shown in the accompanying figures are merely examples that are related to the discussion herein.

CONCLUSION

While one or more embodiments of the device and techniques described herein have been described, various alterations, additions, permutations and equivalents thereof are included within the scope of the techniques described herein.

In the description of embodiments, reference is made to the accompanying drawings that form a part hereof, which show by way of illustration specific examples of the claimed subject matter. It is to be understood that other embodiments may be used and that changes or alterations, such as structural changes, may be made. Such embodiments, changes or alterations are not necessarily departures from the scope with respect to the intended claimed subject matter. While the steps herein may be presented in a certain order, in some cases the ordering may be changed so that certain inputs are provided at different times or in a different order without changing the function of the systems and methods described. The disclosed procedures may also be executed in different orders.

Note, throughout the specification and claims, the term "configured" may be interpreted to mean—in addition to the plain meaning where appropriate—sized, and/or shaped, and/or have structural features to accommodate, engage, or otherwise perform the intended function.

What is claimed is:

1. A strengthening device comprising:

a stretchable band including a first portion and a second portion, wherein the first portion includes a first plurality of attachment points arranged along a length of the first portion and the second portion includes a second plurality of attachment points arranged along a length of the second portion;

a tubular portion having a proximal end and distal end, the tubular portion fixed between the first portion of the stretchable band and the second portion of the stretchable band, the proximal end of the tubular portion having at an opening configured to receive a toe of a user; and a fastener portion having a first attachment point and a second attachment point, such that, when fixed on a lower leg of the user, the first attachment point of the fastener portion is configured to connect with one of the first plurality of attachment points, and the second attachment point of the fastener portion is configured to connect with one of the second plurality of attachment points, thereby creating resistance to the user through dorsiflexion and/or pronation upon application of the strengthening device by the user.

2. The strengthening device of claim 1, wherein the first attachment point of the fastener portion is configured to be disposed on the fastener portion at a position so as to be located on a medial position of a leg of the user when in use on the user, and wherein the second attachment point of the fastener portion is configured to be disposed on the fastener portion at a position so as to be located on a lateral position of the lower leg of the user when in use on the user.

3. The strengthening device of claim 1, wherein the first attachment point of the fastener portion is configured to be disposed on the fastener portion at a position so as to be located on a lateral position of the leg of the user when in use on the user, and wherein the second attachment point of the fastener portion is configured to be located on a medial position of the lower leg of the user.

4. The strengthening device of claim 1, wherein the first attachment point and the second attachment point include one of: Velcro, snap buttons, or hooks.

5. The strengthening device of claim 1, wherein the stretchable band is formed of an elastic material.

6. The strengthening device of claim 1, wherein at least one of the first portion of the stretchable band or the second portion of the stretchable band provides varying levels of resistance by connecting to a second of the plurality of first attachment points or connecting to a second of the plurality of second attachment points.

7. The strengthening device of claim 1, wherein the proximal end of the tubular portion includes a second opening configured to receive a second toe of the user.

8. A method for strengthening an ankle, foot, and/or lower leg, the method comprising:

attaching at least one toe of a foot of a user to a tubular portion of an ankle strengthening device, the tubular portion having an opening configured to receive the at least one toe of the user, and the tubular portion being fixed to a stretchable band including a first portion and a second portion, wherein the first portion includes a first plurality of attachment points arranged along a length of the first portion and the second portion includes a second plurality of attachment points arranged along a length of the second portion;

attaching a fastener portion to a lower leg of the user, the fastener portion having a first attachment point and a second attachment point;

fixing one of the first plurality of attachment points of the first portion of the stretchable band to the first attachment point of the fastener portion such that the first potion of the stretchable band is stretched over at least a portion of a dorsal side of the foot;

fixing one of the second plurality of attachment points of the second portion of the stretchable band to the second attachment point of the fastener portion such that the second portion of the stretchable band is stretched over at least a portion of a planer side of the foot; and alternating between pushing the at least one toe against the resistance and relaxing the at least one toe.

9. The method of claim 8, wherein the first attachment point of the fastener portion is configured to be located on a medial position of the leg of the user, and wherein the second attachment point of the fastener portion is configured to be located on a lateral position of the lower leg of the user such that the user is capable of alternating between dorsiflexion-pronation and plantar flexion-supination.

10. The method of claim 8, wherein the first attachment point of the fastener portion is configured to be located on a medial position of the leg of the user, and wherein the second attachment point of the fastener portion is configured to be located on a lateral position of the lower leg of the user such that the user is capable of alternating between dorsiflexion-supination and plantar flexion-pronation.

11. The method of claim 8, wherein the first attachment point and the second attachment point include Velcro, snap buttons, or hooks.

12. The method of claim 8, wherein the stretchable band is an elastic material.

13. The method of claim 8, wherein the first portion of the stretchable band or second portion of the stretchable band provides varying levels of resistance.

14. A strengthening device, the strengthening device comprising:

a stretchable band including:

a first portion including a first plurality of attachment points arranged along a length of the first portion, a second portion including a second plurality of attachment points arranged along a length of the second portion, and a third portion including at least one opening sized to receive at least one toe of a foot of a user, the third portion located between the first portion of the stretchable band and the second portion of the stretchable band, wherein, when the third portion of the stretchable band is configured to be fixed to the at least one toe of the user, the user is able to:

pull the first portion of the stretchable band in a direction of a lower leg of the user such that at least a portion of the first portion of the stretchable band is configured to be stretched over at least a portion of a dorsal side of the foot and attached using one of the first plurality of attachment points to create resistance, pull the second portion of the stretchable band in a direction of the lower leg such that at least a portion of the second portion of the stretchable band is configured to be stretched over at least a portion of a planer side of the foot and attached using one of the second plurality of attachment points to create resistance, and alternate between pushing the at least one toe against the resistance and relaxing the at least one toe.

15. The strengthening device of claim 14, further comprising a fastener portion having a first attachment point and a second attachment point, configured such that, when fixed on the lower leg of the user, the first attachment point of the fastener is positioned to receive the first portion of the stretchable band, and the second attachment point of the fastener portion is positioned to receive the second portion of the stretchable band, thereby creating resistance through dorsiflexion and/or pronation upon use by the user.

16. The strengthening device of claim 15, wherein the first attachment point of the fastener portion is configured to be located on a medial position of the lower leg of the user, and wherein the second attachment point of the fastener portion is configured to be located on a lateral position of the lower leg of the user.

17. The strengthening device of claim 15, wherein the first attachment point of the fastener portion is configured to be located on a lateral position of the lower leg of the user, and wherein the second attachment point of the fastener portion is configured to be located on a medial position of the lower leg of the user.

18. The strengthening device of claim 15, wherein the first attachment point and the second attachment point include Velcro, snap buttons, or hooks.

19. The strengthening device of claim 14, wherein the stretchable band is an elastic material.

20. The strengthening device of claim 14, wherein at least one of the first portion of the stretchable band or second portion of the stretchable band provides varying levels of resistance.

* * * * *